US005152195A

United States Patent [19]

Merrick

[11] Patent Number: 5,152,195

[45] Date of Patent: Oct. 6, 1992

[54] BREAK-OUT DEVICE FOR STUDS

[75] Inventor: Jake Merrick, Lubbock, Tex.

[73] Assignee: Trycon Services, Inc., Stuart, Fla.

[21] Appl. No.: 772,578

[22] Filed: Oct. 7, 1991

[51] Int. Cl.[5] ..... B25B 13/50

[52] U.S. Cl. ..... 81/53.2; 81/128; 279/71

[58] Field of Search ..... 81/53.2, 128, 90.2; 279/66, 71, 110

[56] References Cited

U.S. PATENT DOCUMENTS

| | | | |
|---|---|---|---|
| 2,582,444 | 1/1952 | Lucht | 81/128 |
| 2,701,724 | 2/1955 | Harris | 279/71 |
| 4,724,730 | 2/1988 | Mader et al. | 81/53.2 |
| 4,856,386 | 8/1989 | Rodriguez | 81/53.2 X |

*Primary Examiner*—James G. Smith
*Attorney, Agent, or Firm*—James E. Bradley

[57] ABSTRACT

A device for gripping a stud to unscrew the stud includes a tubular housing. The housing has an axial bore with a plurality of cam surfaces formed in the bore. A cage is carried in the bore. The cage has a number of windows, each located adjacent one of the cam surfaces. A jaw is carried in each window of the cage. Each jaw has an outer side that mates with one of the cam surfaces and an inner side containing teeth for gripping the stud. The cam surfaces will move each jaw radially between inner and outer position when the housing rotates relative to the cage. A spring urges the jaws to the outer position.

9 Claims, 2 Drawing Sheets

BREAK-OUT DEVICE FOR STUDS

BACKGROUND OF THE INVENTION

1. Field of the Invention

This invention relates in general to devices for unscrewing threaded members, and in particular to a socket member that will slide over a threaded rod or stud to engage and loosen the stud.

2. Description of the Prior Art

In industry, there are numerous applications in which threaded rods or studs must be broken out. Often these studs will have encountered extreme conditions of temperature and weather, causing rust. Also, the studs may have been initially installed under considerable torque. As a result, breaking out the studs is often a difficult task.

In U.S. Pat. No. 4,932,292, Jun. 12, 1990, a device is shown that is particularly used for breaking out sucker rods for beam type pumps. That device uses jaws which slide on cam surfaces between inner and outer positions.

SUMMARY OF THE INVENTION

In this invention, the apparatus has a housing with a bore. Cam surfaces are formed in the bore. A cage is carried in the bore, the cage having windows. A jaw is carried in each window of the cage. A spring urges each jaw outward. The cam surface will push each jaw inward when the housing rotates relative to the cage.

DETAILED DESCRIPTION OF THE INVENTION

Figure 1:
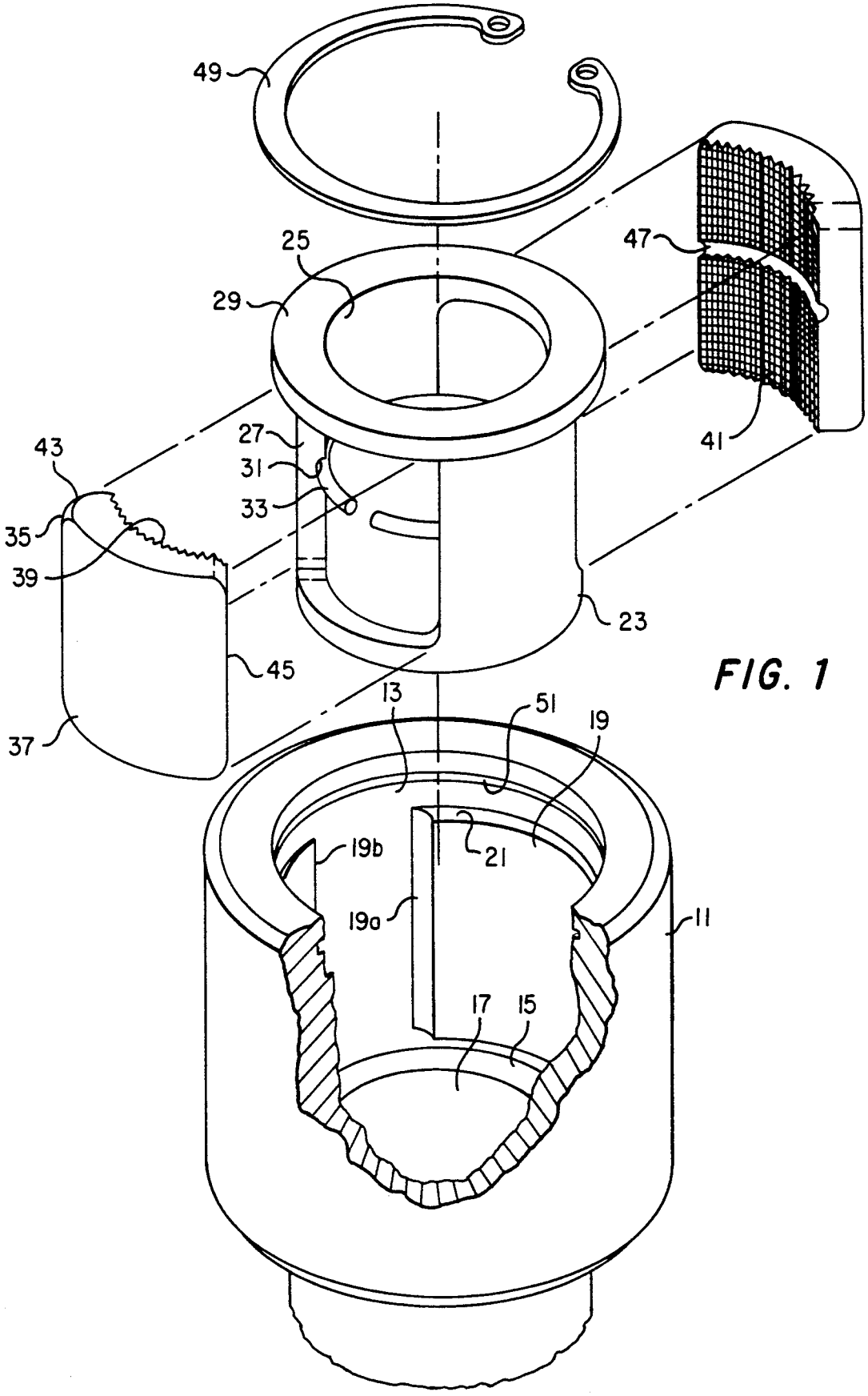
FIG. 1 is a partial exploded perspective view of an apparatus constructed in accordance with this invention.

Referring to FIG. 1, the apparatus in this invention includes a housing 11. Housing 11 is a tubular cylindrical member having an axial bore 13. A lower shoulder 15 is formed in bore 13. Bore 13 has a lower portion 17 that extends below the lower shoulder 15. The lower portion 17 may extend two feet or more. The lower portion 17 is of lesser diameter than the portion of the bore 13 above lower shoulder 15. A polygonal recess or socket (not shown) is located at the lower end of the housing 11 for receiving the rotary drive shank of an air impact tool.

Figure 2:
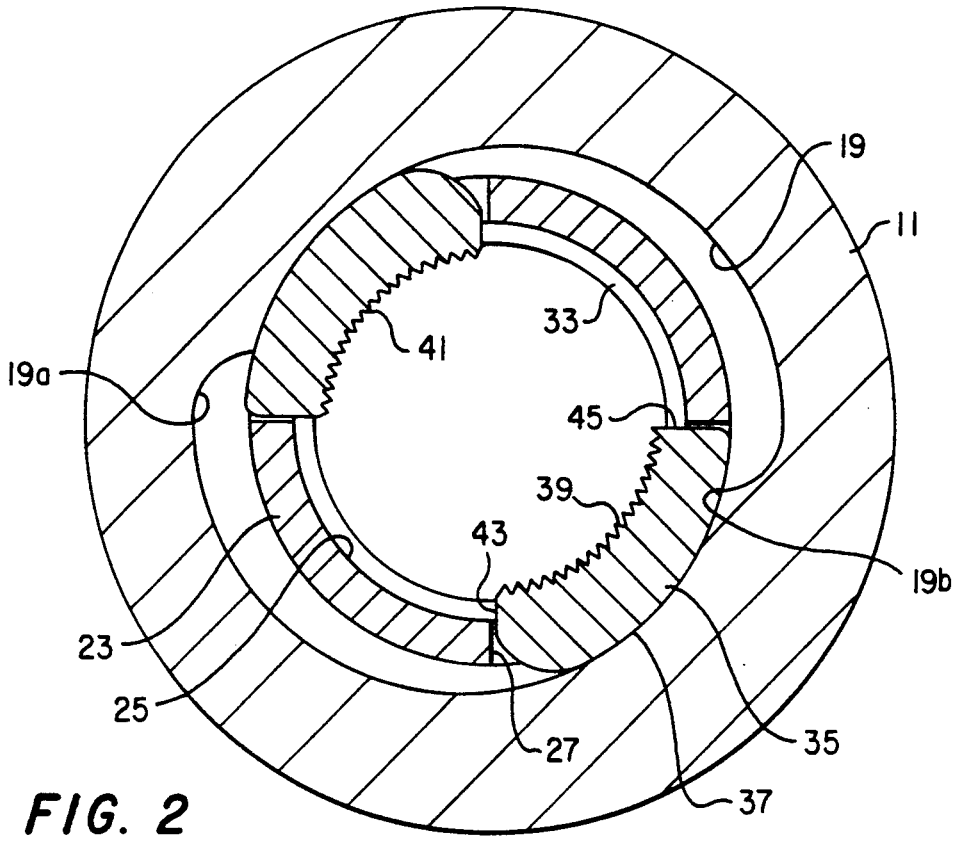
FIG. 2 is a sectional view of the apparatus of FIG. 1, shown assembled, and showing the jaws in an inner position.
Figure 3:
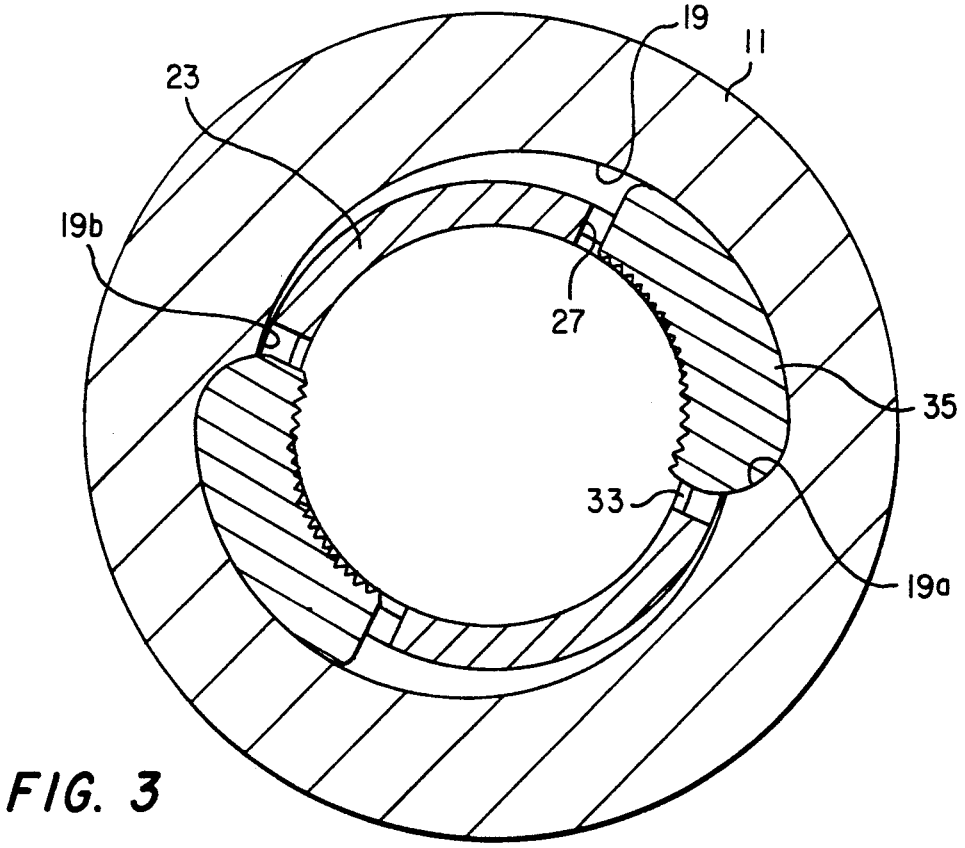
FIG. 3 is a sectional view of the apparatus of FIG. 1, as shown in FIG. 2, but showing the jaws in an outer position.

As shown also in FIGS. 2 and 3, two cam surfaces 19 are formed in bore 13 above lower shoulder 15. Each cam surface 19 is a smooth curved surface that moves gradually inward in a radial direction toward the axis of bore 13. The farthest distance from cam surface 19 to the axis is at the outer end 19*a*, while the closest distance is at the inner end 19*b*. Each cam surface 19 is located above lower shoulder 15 Each cam surface 19 has an upper edge 21 that is perpendicular to the axis of housing 11 and located below the upper end of housing 11. Upper edges 21 are located in a common plane, defining a shoulder.

Referring particularly to FIG. 1, a cage 23 locates in bore 13. Cage 23 is a cylindrical sleeve member. The exterior of cage 23 is cylindrical, as well as its inner diameter 25. Two windows 27 are formed in cage 23. Windows 27 are generally rectangular in configuration, having upper and lower edges that are parallel to each other and perpendicular to side edges. Cage 23 has an outward protruding flange 29 located on its upper end. Flange 29 locates on the upper edges 21 of the cam surfaces 19. Flange 29 supports cage 23 in housing 11. Housing is capable of limited rotation relative to cage 23.

A groove 31 is formed in the inner diameter 25 of cage 23. Groove 31 extends circumferentially around inner diameter 25 perpendicular to the longitudinal axis of cage 23. A wire spring 33 snaps into groove 31. Spring 33 is a resilient circular wire that is split so that it can contract and expand. It is in a contracted position while in groove 31, exerting a radial outward force against groove 31.

A jaw 35 is carried in each window 27. Each jaw 35 has a generally rectangular configuration for closely being received in each window 27. Each jaw 35 has a smooth outer side 37 that is curved for mating with one of the cam surfaces 19. Each jaw has a curved inner side 39 that is located on a single radius. Teeth 41 are formed on the inner side 39.

Each jaw 35 has a thicker edge 43 that tapers gradually to a thinner edge 45, as illustrated in FIG. 2. The difference in thickness of jaws 35 is selected so as to accommodate the contour of the cam surfaces 19. When the jaws 35 move inward to an inner position, the inner sides 39 will be located on a radius of the axis, as can be seen by comparing FIG. 3 with FIG. 2. As a result, the teeth 41 will engage a cylindrical threaded rod or stud (not shown) evenly across the width of jaw 35.

Referring again to FIG. 1, each jaw 35 has a groove 47 formed on its inner side 39. Groove 47 is a circumferentially extending groove located about midway along the length of each jaw 35. Groove 47 will register with the groove 31 and the spring 33. The spring 33 will locate in the groove 47 to urge the jaws 35 outward from cage 23.

Referring still to FIG. 1, cage 23 is retained in the housing 11 by a retainer or snap ring 49. Retainer ring 49 snaps into a groove 51 spaced above the cam surface upper edges 21. The cage flange 29 will be sandwiched between the cam surface upper edges 21 and the retainer ring 49.

In operation, the device will appear as shown in FIG. 3. The spring 33 (FIG. 1) will exert a force on the jaws 35 that pushes them outward. The outward force will have caused cage 23 to rotate relative to housing 11 a limited amount until the jaws 35 are located in the outer positions in contact with outer ends 19*a*. Spring 33 will be located in grooves 31, 47. A portion of the teeth 41 will be substantially flush with the inner diameter 25 of the cage 23.

The user will insert the housing 11 over the stud to be unscrewed. If the stud is of a type having threads on its upper end and a cylindrical shank below, the user will insert the housing 11 until the cylindrical shank portion of the stud locates in the area of the jaws 35. The threaded portion will extend into the extended or lower bore portion 17. The user will connect a rotary power tool, such as an air impact wrench to the lower end of the housing 11. The user will do this by inserting the drive head of the impact tool into the polygonal recess (not shown) in the lower end of housing 11.

The user then will spin the housing 11 by energizing the power tool. The spinning will be at fairly high speed. Inertia of the cage 23 and jaws 35 will cause the housing 11 to rotate a limited amount relative to the cage 23. During this rotation, the cage 23 will slip relative to housing 11.

This results in the jaws 35 sliding on the cam surfaces 19 from the outer position shown in FIG. 3 toward the inner position shown in FIG. 2. In the inner position, the spring 33 will still engage the grooves 47 in the jaws 35, but may be spaced inward of the groove 31 in the cage 23. Even in the inner position, the jaws 35 will still be partially located in the windows 27. The teeth 41 will engage the stud, causing the stud to rotate with the housing 11. This unscrews the stud.

The invention has significant advantages. The jaws are carried in a cage member. The cage maintains jaw positions in a less complex manner than prior art gripping devices utilizing cam actuated jaws.

While the invention has been shown in only one of its forms, it should be apparent to those skilled in the art that it is not so limited, but is susceptible to various changes without departing from the scope of the invention.

I claim:

1. An apparatus for gripping a threaded member to rotate the threaded member, comprising in combination:

a housing having an axial bore with an axis and an open end, the housing being adapted to be connected to a rotary power source for rotation therewith;

a plurality of cam surfaces formed in the bore, each cam surface extending circumferentially a selected distance and decreasing in distance to the axis from an outer end to an inner end;

a cage carried in the bore, the cage having a plurality of windows, each located adjacent one of the cam surfaces;

a jaw carried in each window of the cage, each having an outer side that mates with one of the cam surfaces and an inner side adapted to grip the threaded member, each jaw being radially movable relative to the cage between an outer position in which each jaw is at the outer end of one of the cam surfaces to an inner position in which each jaw is at the inner end of one of the cam surfaces;

the housing being rotatable relative to the cage such that when the power source rotates the housing, inertia of the cage and jaws will cause the housing to rotate a limited amount relative to the cage and jaws, causing the cam surfaces to force the jaws toward the inner position to grip the threaded member; and wherein:

the housing bore has a shoulder; and the cage is cylindrical and has an outward extending flange on one end for engaging the shoulder to support the cage and the jaws.

2. An apparatus for gripping a threaded member to rotate the threaded member, comprising in combination:

a housing having an axial bore with an axis and an open end, the housing being adapted to be connected to a rotary power source for rotation therewith;

a plurality of cam surfaces formed in the bore, each cam surface extending circumferentially a selected distance and decreasing in distance to the axis from an outer end to an inner end;

a cage carried in the bore, the cage having a plurality of windows, each located adjacent one of the cam surfaces;

a jaw carried in each window of the cage, each having an outer side that mates with one of the cam surfaces and an inner side adapted to grip the threaded member, each jaw being radially movable relative to the cage between an outer position in which each jaw is at the outer end of one of the cam surfaces to an inner position in which each jaw is at the inner end of one of the cam surfaces;

the housing being rotatable relative to the cage such that when the power source rotates the housing, inertia of the cage and jaws will cause the housing to rotate a limited amount relative to the cage and jaws, causing the cam surfaces to force the jaws toward the inner position to grip the threaded member; and wherein:

each of the cam surfaces has an edge located within the bore, the edge defining a shoulder that faces toward the open end of the bore; and the cage is cylindrical and has an outward extending flange on one end for engaging the shoulder to support the cage and the jaws.

3. An apparatus for gripping a threaded member to rotate the threaded member, comprising in combination:

a housing having an axial bore with an axis and an open end, the housing being adapted to be connected to a rotary power source;

a plurality of cam surfaces formed in the bore, each cam surface extending circumferentially a selected distance and decreasing in distance to the axis from an outer end to an inner end;

a cage carried in the bore, the cage having open first and second ends and a cylindrical sleeve portion containing a plurality of windows, each window located adjacent one of the cam surfaces;

the bore of the housing having an extended portion extending past the cage in a direction away from the open end of the bore for a distance sufficient to allow the threaded member to be inserted through the cage and into the extended portion of the bore;

a jaw carried in each window of the cage, each having an outer side that mates with one of the cam surfaces and an inner side having teeth to grip the threaded member, each jaw being radially movable relative to the cage between an outer position in which each jaw is at the outer end of one of the cam surfaces to an inner position in which each jaw is at the inner end of one of the cam surfaces;

a spring carried by the cage and engaging the jaws for urging the jaws toward the outer position; and the housing being rotatable relative to the cage such that when the power source rotates the housing, inertia of the cage and jaws will cause the housing to rotate a limited amount relative to the cage and jaws, causing the cam surfaces to force the jaws toward the inner position to grip the threaded member.

4. The apparatus according to claim 3 wherein:

the sleeve portion of the cage has an inner diameter containing a circumferentially extending groove; and the spring comprises a resilient wire member that locates in the groove and engages the inner sides of the jaws.

5. The apparatus according to claim 3 wherein:

the sleeve portion of the cage has an inner diameter containing a circumferentially extending groove;

each of the jaws has a circumferentially extending groove that is located on the inner side of the jaws and which registers with the groove of the cage; and the spring comprises a resilient wire member that locates in the grooves of the cage and the jaws.

6. The apparatus according to claim 3 wherein:

the housing bore has a shoulder; and the cage has an outward extending flange on one end for engaging the shoulder to support the cage and the jaws.

7. The apparatus according to claim 3 wherein:

each of the cam surfaces has an edge located within the bore and facing toward the open end of the bore, the edge defining a shoulder; and the cage is cylindrical and has an outward extending flange on one end for engaging the shoulder to support the cage and the jaws.

8. An apparatus for gripping a threaded member to rotate the threaded member, comprising in combination:

a housing having an axial bore with an axis and an open upper end, the housing being adapted to be connected to a rotary power source;

a plurality of cam surfaces formed in the bore, each cam surface extending circumferentially a selected distance and decreasing in distance to the axis from an outer end to an inner end;

each of the cam surfaces having an upper edge;

a cage carried in the bore, the cage having open upper and lower ends, an outward protruding flange on its upper end that is supported on the upper edges of the cam surfaces, the cage having a cylindrical sleeve portion extending below the flange and containing a plurality of windows, each window located adjacent one of the cam surfaces;

the sleeve portion of the cage having an inner diameter and a circumferentially extending groove located therein;

the bore of the housing having a lower portion extending below the cage for a distance sufficient to allow the threaded member to be inserted through the cage and into the lower portion of the bore;

a jaw carried in each window of the cage, each having an outer side that mates with one of the cam surfaces and an inner side having teeth to grip the threaded member, each jaw being radially movable relative to the cage between an outer position in which each jaw is at the outer end of one of the cam surfaces to an inner position in which each jaw is at the inner end of one of the cam surfaces;

each jaw having a circumferentially extending groove located between upper and lower ends of the jaws on the inner side of each jaw and registering with the groove in the cage;

a resilient wire spring carried in the grooves of the cage and the jaws for urging the jaws toward the outer position; and the housing being rotatable relative to the cage such that when the power source rotates the housing, inertia of the cage and jaws will cause the housing to rotate relative to the cage and jaws, causing the cam surfaces to direct the jaws toward the inner position to grip the threaded member.

9. The apparatus according to claim 8 further comprising:

a retainer ring mounted in the bore above the flange for retaining the cage in the housing.

* * * * *